US005649728A

United States Patent [19]

Warthen

[11] Patent Number: 5,649,728

[45] Date of Patent: Jul. 22, 1997

[54] TONG-LIKE EATING UTENSIL

[76] Inventor: Benjamin R. Warthen, 431 E. Central Blvd. Apt. 317, Orlando, Fla. 32801

[21] Appl. No.: 691,555

[22] Filed: Aug. 2, 1996

[51] Int. Cl.[6] ..... A47G 21/10; A47J 43/28

[52] U.S. Cl. ..... 294/16; 294/5; 294/99.2

[58] Field of Search ..... 294/3, 5, 7, 8, 294/8.5, 11, 16, 25, 33, 99.2, 100, 106, 902

[56] References Cited

U.S. PATENT DOCUMENTS

| | | | |
|---|---|---|---|
| D. 25,026 | 12/1895 | Bishop | 294/5 X |
| 557,935 | 4/1896 | Albrecht | 294/5 |
| 568,237 | 9/1896 | Carley | 294/5 |
| 2,465,626 | 3/1949 | Barrett | 294/5 |
| 4,728,139 | 3/1988 | Oretti | 294/99.2 |
| 4,802,704 | 2/1989 | Burns | 294/25 X |
| 4,923,234 | 5/1990 | Fairley | 294/5 X |

*Primary Examiner*—Johnny D. Cherry

*Attorney, Agent, or Firm*—Dorothy S. Morse, Esq.; American Innovations, Inc.

[57] ABSTRACT

A tong-like eating utensil having opposing prongs on the inside distal ends thereof for use by a person in gripping pieces of food so that the person's hands do not come into direct contact with the food. Handles connected to rotating prong support brackets allow food secured by the prongs to be rotated into a variety of convenient positions for easy consumption. Heat insulating end members may be connected between the handles and the rotating prong support brackets to protect the user's hands from hot food. Applications may include, but are not limited to, use in gripping finger foods such as barbecued chicken wings, shrimp dipped in seafood sauce, and hot buttery foods such as bread sticks.

8 Claims, 1 Drawing Sheet

TONG-LIKE EATING UTENSIL

BACKGROUND—FIELD OF INVENTION

This invention relates to the field of eating utensils, specifically to a tong-like eating utensil having opposing prongs on the inside distal ends thereof for use by a person in gripping pieces of food so that the person's hands do not come into direct contact with hot and sticky food, with handles connected to rotating prong support brackets which allow the food secured by the prongs to be rotated into a variety of convenient positions for efficient consumption. Applications may include, but are not limited to, use in gripping finger foods such as barbecued chicken wings, shrimp dipped in seafood sauce, and hot buttery bread sticks.

BACKGROUND—DESCRIPTION OF PRIOR ART

Finger foods, such as hot chicken wings, are popular in bars, at catered buffets, and in some restaurants. Toothpicks, which are sometimes available for picking up and eating small pieces of finger food such as cheese, fruit, meatballs, and cocktail size hot dogs, are inadequate to support the weight of a chicken wing. Also, since there is little meat on each chicken wing, knives and forks are usually inadequate to help a person eat the chicken wings. As a result, people wanting to eat chicken wings must usually eat them with their fingers. Many finger foods are hot and many tend to have sticky sauces, such as a barbecue sauce, cooked onto their outside surfaces which becomes transferred to the eater's fingers when the finger food is held by hand during consumption. The stickiness left on the eater's hands by such finger food is not easily removed without soap and water. When paper napkins, which are usually available to people eating in a bar or restaurant, are used to remove a sticky sauce from the eater's fingers, some of the sauce may be successfully removed, but the majority of it remains on the eater's hands. Also, during the process of wiping the sticky sauce from the eater's fingers, the paper napkins usually shred leaving pieces of paper also stuck to the eater's fingers. It would be useful to have a utensil for eating finger foods, such as barbecued chicken wings, so that people eating them do not have to directly contact them with their fingers.

Tong-like devices are known for use in food preparation and the serving of food. It is known to have salad tongs for serving lettuce and vegetable pieces which often comprise a fork-like protuberance on one of its distal ends and an opposing spoon-like protuberance on the other of its distal ends. It is also known to have toast tongs, made of material which does not conduct heat, such as wood, for retrieval of pieces of toast which become stuck in a toaster. The distal ends of the toast tongs are usually flat so as not to crush or tear the piece of bread being withdrawn from the toaster. It is also known to have barbecue tongs for turning pieces of food on a grill, fireplace tongs useful for handling larger pieces of grilled food, and general purpose kitchen tongs usable to perform such tasks as picking up hot ears of corn from a pot of boiling water or handling food which is being fried. Such tongs typically have serrated distal ends, or distal ends having a rippled configuration, for secure gripping of food and other objects. No tongs are known to have rotating prong support brackets on their distal ends for varied positioning of the objects which they grip. A tong-like device is known for use in holding snail shells during eating of a snail which has been placed within the snail shell and cooked. The distal ends of such tong-like devices are shaped to conform to the shape of a snail shell but do not have prongs, nor rotating prong support brackets, for holding the snail shells during use. Also, neither knives, forks, spoons, chopsticks, nor corn-on-the-cob holders, which are used in pairs and have an elongated handle portion with prongs on one end for insertion into the ends of a hot ear of corn during consumption, are adequate for assisting a person in eating small pieces of finger food at a bar, restaurant, or buffet.

SUMMARY OF INVENTION—OBJECTS AND ADVANTAGES

It is the primary object of this invention to provide a tong-like food support for use in eating small hot pieces of finger food so that the eater does not have to directly contact the hot finger food with his or her hands. It is also an object of this invention to provide a tong-like food support for use in eating small sticky pieces of finger food so that the eater does not have to directly contact the sticky finger food with his or her hands. It is a further object of this invention is to provide a tong-like food support for use in holding small pieces of finger food in varied positions so that it is easily eaten. It is also an object of this invention to provide a food support for use in eating small pieces of finger food that is not awkward to use.

As described herein, properly manufactured, and used, the present invention would provide a means to securely grip hot and sticky finger food in many convenient positions for eating. The present invention grips a piece of food with opposed prongs attached to rotating brackets connected to the inside end surfaces of main tong frame members. A handle is connected on the outside end surface of each main tong frame member and is rotatable to cause the attached tong support bracket to also rotate into convenient positions for consumption of the piece of food that is being eaten. It is contemplated for two main tong frame members to be connected at one end by a hinge pin with its two distal ends biased in an opened position by spring means. Gripping indentations on the outside surfaces of the main tong frame members provide additional means for users to securely grasp the present invention during use. The present invention offers users an easy-to-use tong-like utensil by which a user may grasp, eat, and dispose of food without any part of the held food coming in direct contact with their hands.

The description herein provides preferred embodiments of the present invention but should not be construed as limiting the scope of the food tong invention. For example, variations in the length and configuration of the gripping indentations, the size and configuration of the hinge pin used to hold the two connected ends of the main tong frame members together, the size and type of spring means used to bias the non-hinged distal ends of the main tong frame members into opened positions, the size and configuration of each handle, the length and number of prongs used, the placement configuration of the prongs, and the material from which the main tong frame connecting strap is made, other than those shown and described herein, may be incorporated into the present invention. Thus, the scope of the present invention should be determined by the appended claims and their legal equivalents, rather than the examples given.

DETAILED DESCRIPTION OF PREFERRED EMBODIMENTS

Figure 1:
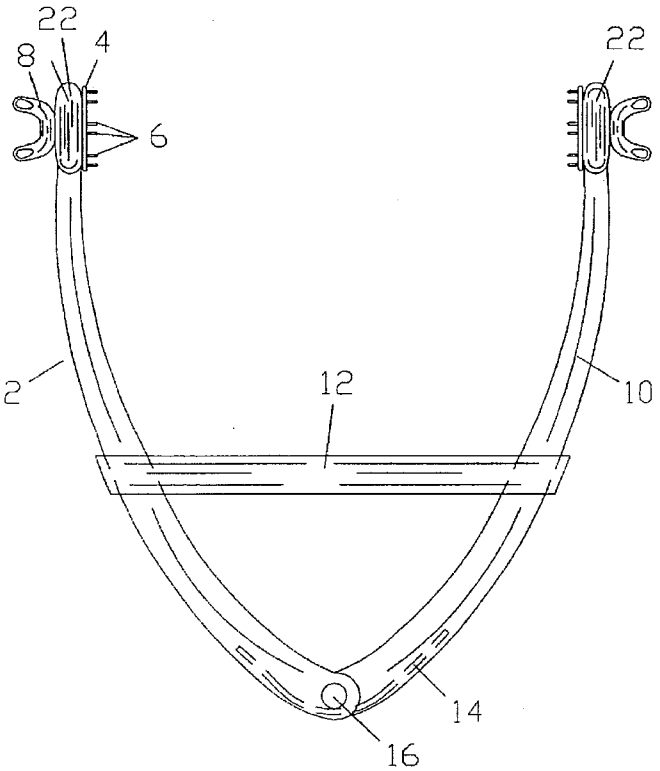
FIG. 1 is a perspective view of the invention.

FIG. 1 shows a preferred embodiment of a tong-like eating utensil 2 having two elongated main tong frame members 10. Both main tong frame members 10 are approximately equal length and are held together at one end by a hinge pin 16, while at the same time being biased apart by spring means 14 which is positioned between main tong frame members 10 and adjacent to hinge pin 16. FIG. 1 also shows the other end of each main tong frame member 10 having prongs 6 attached to a rotating prong support bracket 4. Rotating prong support brackets 4 are each attached through the non-hinged end of each main tong frame member 10 to a handle 8 so that prongs 6 on one main tong frame member 10 face other prongs 6 which are attached on the non-hinged end of the opposing one of said main tong frame members 10. An end member 22 is shown connected between each main tong frame member 10 and its adjacent rotating prong support bracket 4. When tong-like eating utensil 2 is used for consumption of hot foods, end members 22 may be made of insulating materials to block heat transfer from the hot food to handles 8. However, the use of end members 22 is not critical to tong-like eating utensil 2. A flexible connecting strap 12 is centrally connected between opposing main tong frame members 10. It is contemplated for connecting strap 12 to be made of materials which are not affected by exposure to water, detergents, or the elevated temperatures used during dishwasher operation. Also, connected to the outside surface of each end member 22 is one handle 8 which may be used to rotate pieces of food (not shown) placed between prongs 6 into varied positions for easy consumption. In the preferred embodiment, it is contemplated for tong-like eating utensil 2 to be made from stainless steel and to be one-half inch in height, as well as to be approximately six inches in length and ranging between two and six inches in width as it moves between opened and closed positions. It is also contemplated for tong-like eating utensil 2 to be made from other materials, such as a rigid plastic, which would not be affected by exposure to water, detergents, or the elevated temperatures used during dishwasher operation. It is also contemplated for tong-like eating utensil 2 to have main tong frame members 10 which are provided as a multi-piece assembled unit, as well as main tong frame members 10 which are formed as a one piece unit and made from molded construction.

Figure 3:
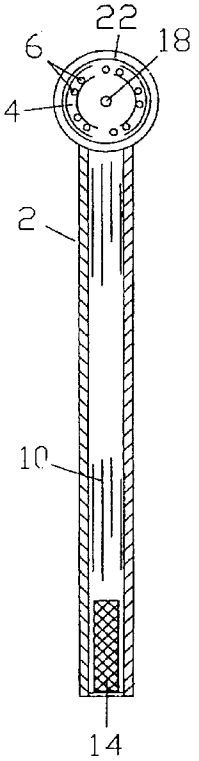
FIG. 3 is a sectional view of the invention.
Figure 2:
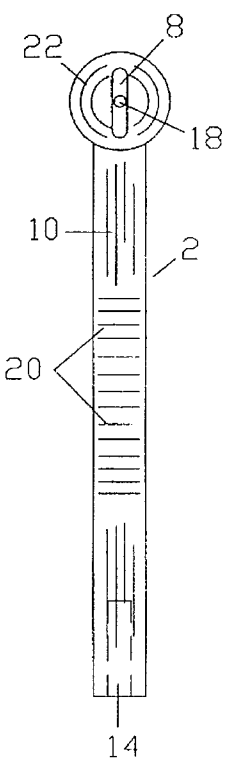
FIG. 2 is a side view of the invention.

FIG. 2 shows the preferred embodiment of tong-like eating utensil 2 having a connecting pin 18 to secure handle 8 to the outside portion of end member 22 on the non-hinged distal end of each main tong frame member 10. FIGS. 2 and 3 show spring 14 positioned against the hinged end of main tong frame members 10. FIG. 2 shows main tong frame members 10 each having a plurality of gripping indentations 20 centrally located on its outside surface to provide improved gripping means for a user to firmly hold when employing tong-like eating utensil 2 to eat a piece of food. FIG. 3 shows prongs 6 connected to the inner surface of rotating prong support bracket 4 and spaced evenly near the perimeter of prong support bracket 4.

To use tong-like eating utensil 2 a person desiring to eat a small piece of food would hold tong-like eating utensil 2 in one hand, with prongs 6 in an opened position, and move tong-like eating utensil 2 adjacent to the piece of food (not shown) intended for eating. By using the little finger on the hand holding tong-like eating utensil 2, or the little finger and its adjacent finger, a user (not shown) would pull connecting strap 12 downward toward hinge pin 16 to close the distal ends of main tong frame members 10 toward each other, allowing prongs 6 to enclose around the intended piece of food (not shown) and grip it. Since spring means 14 biases the distal ends of main tong frame members 10 apart, the user would have to continue to hold connecting strap 12 in its downward position or apply a closing force with his or her hand to the outside surfaces of main tong frame members 10 to maintain prongs 6 in a closed position around the intended piece of food during eating. By using handles 8 to rotate rotating prong support bracket 4, the user is able to cause rotation of the intended piece of food (not shown) into a variety of positions convenient for eating. Upon release of connecting strap 12 and cessation of any applied closing force, the distal ends of main tong frame members 10 are again biased to move away from one another so that any remnants of the piece of food, such as a bone, may be discarded and other pieces of food (not shown) may be subsequently gripped for convenient eating without the eater's hands directly contacting the food.

What is claimed is:

1. A tong-like eating utensil for use by a person to grip small pieces of food so that said pieces of food do not come into direct contact with said person's hands during consumption, said tong-like eating utensil comprising two main tong frame members each having a first end and a second end, each of said first ends being connected to the other of said first ends; connection means to connect said first ends to one another so that said second ends of both of said main tong frame members are movable toward one another into closed positions and movable away from one another into opened positions; spring means attached between said first ends to bias said main tong frame members into said opened positions; at least one connecting strap connected between said main tong frame members for use in moving said second ends of said main tong frame members into said closed positions; a plurality of elongated, rigid prongs, each of said prongs having sufficient length for insertion into, and secure gripping of, said small pieces of food, each of said prongs also having a central axis; two planar prong support brackets, each of said prongs being attached to one of said prong support brackets so that each of said central axes is approximately perpendicular to one of said planar prong support brackets, one of said prong support brackets being rotatingly attached to each of said second ends of said main tong frame members so that said prongs on each of said main tong frame members face said prongs which are attached to the other of said main tong frame members for secure gripping of said small pieces of food between said prongs when said main tong frame members are in said closed positions, and said tong-like eating utensil further comprising two handles, one of said handles rotatably connected to each of said prong support brackets so that manual movement of each of said handles by said person's hands causes one of said prong support brackets to rotate which also causes said pieces of food supported between said prongs to rotate into varied positions for easier consumption.

2. The tong-like eating utensil of claim 1 wherein said connection means comprises at least one hinge pin.

3. The tong-like eating utensil of claim 1 wherein said main tong frame members are made of plastic and said connection means comprises one-piece molded construction.

4. The tong-like eating utensil of claim 1 wherein said main tong frame members each have an outside surface and further comprising a plurality of gripping indentations on said outside surfaces.

5. The tong-like eating utensil of claim 1 wherein each of said main tong frame members is approximately six inches in length, one-half inch in height, and ranges in width from two inches in said smallest closed position to six inches in said largest opened position.

6. The tong-like eating utensil of claim 1 further comprising an end member connected between each of said rotating prong support brackets and the one of said handles connected thereto, and wherein each of said end members comprises insulating materials to block transfer of heat from said pieces of food to said handles.

7. A tong-like eating utensil for use by a person to grip finger foods so that said finger foods do not come into direct contact with said person's hands during consumption of said finger foods, said tong-like eating utensil comprising two main tong frame members each having a first end and a second end, each of said first ends being movably connected to the other of said first ends, each of said main tong frame members having an outside surface and a plurality of gripping indentations on each of said outside surfaces; at least one hinge pin to connect said first ends to one another so that said main tong frame members are movable between opened and closed positions; spring means attached between said first ends to bias said main tong frame members into said opened positions; at least one connecting strap connected between said main tong frame members for use in moving said second ends of said main tong frame members into said closed positions; a plurality of elongated, rigid prongs, each of said prongs having sufficient length for insertion into, and secure gripping of, said finger foods, each of said prongs also having a central axis; two planar rotating prong support brackets, each of said prongs being attached one of said rotating prong support brackets so that each of said central axes is approximately perpendicular to one of said planar rotating prong support brackets, one of said rotating prong support brackets attached to each of said second ends of said main tong frame members so that said prongs on each of said main tong frame members face said prongs which are attached to the other of said main tong frame members; two handles, one of said handles connected to each of said prong support brackets so that manual movement of each of said handles causes one of said prong support brackets to rotate and said foods supported between said prongs to rotate into varied positions for easier consumption; and wherein each of said main tong frame members is approximately six inches in length, one-half inch in height, and ranges in width from two inches in the smallest of said closed positions to six inches in the largest of said opened positions.

8. A method for use of a tong-like eating utensil to eat small pieces of food without said food coming in direct contact with the fingers of the person attempting to eat said food, said method comprising the steps of providing two main tong frame members, two rotating prong support brackets each having a plurality of prongs depending therefrom, two heat insulating end members, spring means, two handles, a connecting strap, two connecting pins, and a hinge pin; connecting one end of each main tong frame member to the other using said hinge pin; attaching each of said end members adjacent to one of the non-hinged ends of said main tong frame members; attaching one of said handles and one of said rotating prong support brackets to each of said end members with one of said connecting pins so that said prongs depending from each of said end members are directed away from said end members and each of said handles is able to cause rotation of the one of said rotating prong supports brackets to which it is adjacent; connecting each of said end members to the non-hinged end of one of said main tong frame members with said prongs on each of said main tong frame members facing said prongs on the other of said main tong frame members; attaching said connecting strap between said main tong support members; holding said main tong frame members in one hand; using said hand to move said prongs adjacent to one of said small pieces of food; using at least one finger on said hand to pull on said connecting strap to move said connecting strap toward said hinge pin and thereby move said prongs on each of said main tong frame members toward said prongs on the other of said main tong support members and into a closed position around said small piece of food; using said main tong frame members to direct said small piece of food toward the mouth of a user; using said handles to rotate said small piece of food into convenient positions for consumption; and releasing said connecting strap so that said spring means biases said prongs into an opened position away from said small piece of food and said small piece of food can be released from attachment to said prongs.

* * * * *